United States Patent [19]

Roth et al.

[11] 4,005,555

[45] Feb. 1, 1977

[54] ROOF EXPANSION JOINT

[75] Inventors: Abraham H. Roth; Dave Roth, both of Youngstown, Ohio

[73] Assignee: Roth Bros. Inc., Youngstown, Ohio

[22] Filed: July 3, 1975

[21] Appl. No.: 593,013

[52] U.S. Cl. ..... 52/60; 52/573; 52/469

[51] Int. Cl.[2] ..... E04D 1/36

[58] Field of Search ..... 52/58, 60, 573, 465, 52/94, 469

[56] References Cited

UNITED STATES PATENTS

| | | | |
|---|---|---|---|
| 3,296,762 | 1/1967 | Thom | 52/469 X |
| 3,421,267 | 1/1969 | Balzer et al. | 52/58 |

*Primary Examiner*—Price C. Faw, Jr.
*Assistant Examiner*—Carl D. Friedman
*Attorney, Agent, or Firm*—Webster B. Harpman

[57] ABSTRACT

A roof expansion joint for flat built up roofs forms an elevated elongated structure bridging an expansion slot-like opening between adjacent roof sections to provide a movable watertight seal therebetween formed of rigid slideably engaged members.

6 Claims, 3 Drawing Figures

ROOF EXPANSION JOINT

BACKGROUND OF THE INVENTION

1. Field of the Invention

This invention relates to roof expansion joints and weather-tight structures forming the same.

2. Description of the Prior Art

Prior structures of this type usually employ a flexible resilient impervious sheet material extending between and/or overlapping support structures on the adjacent sides of a roof expansion slot-like opening.

This invention eliminates the flexible material seals of the prior art constructions and provides rigid metallic inter-engaging movable components capable of maintaining a weather-tight seal while providing the necessary movement accommodating expansion and contraction of the roof sections movably joined thereby.

SUMMARY OF THE INVENTION

A roof expansion joint useable on new and old roof constructions incorporates continuously extending upstanding members positioned on the opposite sides of a slot-like expansion joint opening in a built up roof and provides inter-engaging movable rigid continuously extending and engaging members closing the slot-like expansion opening and arranged for slideable sealing engagement responsive to expansion and contraction motion of said roof.

DESCRIPTION OF THE PREFERRED EMBODIMENT

Figure 1:
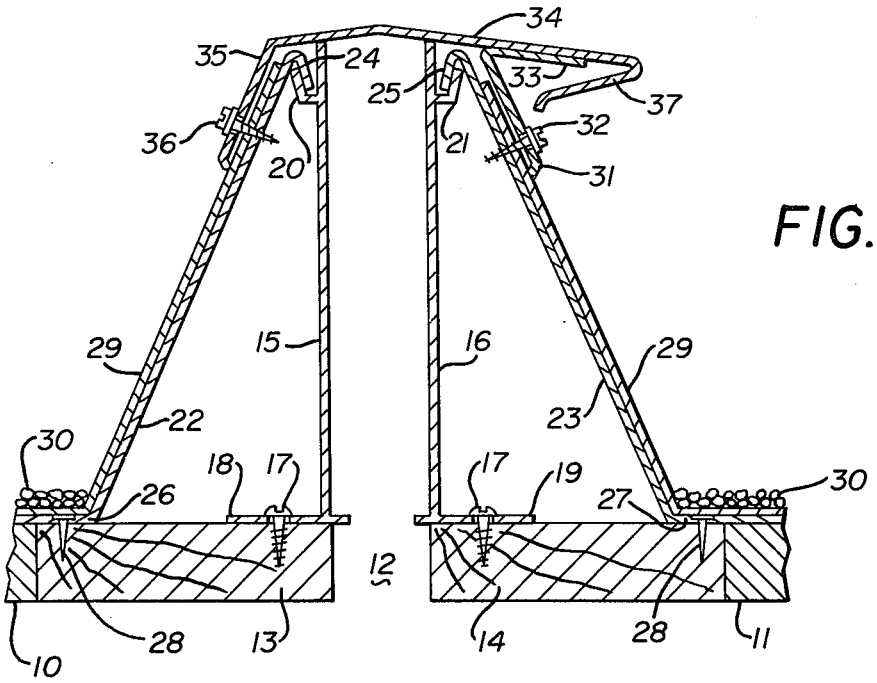
FIG. 1 is a cross sectional elevation with parts broken away of a roof expansion joint embodying the present invention.

By referring to FIG. 1 of the drawings, a preferred embodiment of the invention such as used in a new roof construction may be seen and wherein two adjacent sections of a flat built up roof are generally indicated by the numerals 10 and 11 with their adjacent edges spaced to form a longitudinally extending slot-like opening therebetween and to thereby provide for expansion and contraction movement of the roof sections 10 and 11 as occurs under varying temperature conditions. The opening is indicated by the numeral 12.

The adjacent edges of the roof-like sections 10 and 11 are disclosed as being formed of longitudinal body members 13 and 14 respectively and a pair of oppositely disposed longitudinally extending flanged upright body members 15 and 16 are positioned thereon and secured thereto by fasteners 17 which extend through flanges 18 and 19 on the lower ends of the flanged upright body members 15 and 16. Secondary angular flanges 20 and 21 are formed on the upright body members 15 and 16 inwardly of their upper ends so as to extend outwardly, oppositely therefrom and then upwardly in angular relation thereto. These secondary flanges 20 and 21 terminate inwardly of the uppermost ends of the upright body members 15 and 16.

Still referring to FIG. 1 of the drawings, it will be seen that metal cants 22 and 23 are positioned in angular relation to the flanged upright body members 15 and 16 and have downturned flanges 24 and 25 respectively on their upper ends engaged in hooked relation over the longitudinally extending angular flanges 20 and 21 so as to be supported thereby. The cants 22 and 23 extend downwardly and outwardly from their point of attachment and support on the secondary flanges 20 and 21 and their lower outer ends are outturned as at 26 and 27 and they are secured to the longitudinal body members 13 and 14 of the adjacent roof sections 10 and 11 by fasteners 28. Roofing material 29 as used in forming a built up roof is then applied to the roof sections 10 and 11 and extends upwardly on the angular cants 22 and 23 and may be secured as with liquid asphalt or the like as will occur to those skilled in the art. The section 29 may comprise composition base flashing as known in the art and it and the built up roof are finished with a coating of crushed stone 30 in liquid asphalt, tar or the like as commonly found in a built up roof construction.

Still referring to FIG. 1 of the drawings, it will be seen that a continuous angle member 31 is attached to the cant 23 longitudinally thereof by fasteners 32 positioned through one portion of the angle member 31 and engaged in the cant 23 so that the continuous angle member 31 overlies the roofing material 29. The other portion 33 of the continuous angle member 31 extends outwardly and on the same level as the upper end of the cant 23 to form a transversely flat, relatively wide support on which a doubly flanged longitudinal extending joint cover is positioned. As seen in FIG. 1 of the drawings, the left side of the joint cover 34 has a downturned angular flange 35 which is secured to the cant 22 by a fastener 36 in overlying relation to the roofing material 29 thereon as heretofore described and that the other opposite longitudinal edge of the joint cover 34 has a continuously extending inturned angularly disposed flange 37 which extends inwardly toward the cant 23 and the angle member 31 in spaced relation to the flange 33 thereof. It will be observed that the width of the joint cover 34 is substantially greater than the total width of the upper ends of the cants 22 and 23 including the angular flange 33 of the angle 31 so that a sliding weatherproof expansion joint is formed between the joint cover 34 and the angle member 33 on the right side of the expansion joint shown in FIG. 1 of the drawings while the left side thereof is secured to the cant 22 in sealing relation to the roofing material 29 thereon by the fasteners 36.

It will thus be observed that when the roof sections 10 and 11 move toward and away from one another as a result of temperature changes and the resulting expansion or contraction of the roof section, the upright members 15 and 16 will move therewith toward and away from one another as will the cants 22 and 23 and the sections of roofing material 29 which extend upwardly therealong. The joint cover 34 will move with the upstanding body member 15 and the roof section 10 and the angle member 31 with its outturned flange 33 will move with the cant 23, the upstanding body member 16 and the roof section 11. A sliding sealing expansion joint is maintained between the flange 33 and the joint cover 34 and enclosed by the inturned flange 37. It will be seen that the construction disclosed permits free and easy movement of the roof sections 10 and 11 relative to one another while maintaining the weather-tight seal of the expansion joint structure and that no resilient, flexible or other easily damagable material is employed or necessary.

In the form of the invention illustrated in FIG. 1 of the drawings, the flanged upright body members 15 and 16 desirably take the form of aluminum extrusions, the cants 22 and 23 are advantageously formed of roll formed sheet metal and can be aluminum extrusions, the angle member 31 can be easily and inexpensively formed of sheet metal and the joint cover 34 is advantageously formed as an aluminum extrusion. The several parts are easily assembled in elongated sections in a minimum of installation time.

Figure 2:
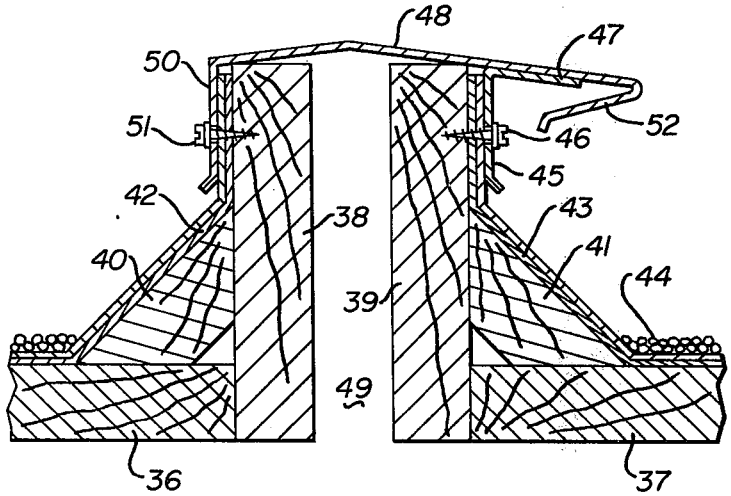
FIG. 2 is a cross sectional elevation of the roof expansion joint of the invention applied to an old roof expansion joint structure.

Modifications of the invention will occur to those skilled in the art and one such modification wherein the construction is applied to an old expansion joint structure in an existing roof may be seen in FIG. 2 of the drawings.

By referring to FIG. 2 of the drawings, the adjacent roof sections are indicated by the numerals 36 and 37 and include spaced adjacent wooden uprights such as two by tens or the like as indicated at 38 and 39. Wooden cants 40 and 41 are used in such constructions and composition base flashing material 42 and 43 extends upwardly over the wooden cants 40 and 41 and along the outer opposite sides of the wooden uprights 38 and 39. A built up roof is applied thereto including the crushed stone 44. Originally flexible material connected the wooden uprights.

In FIG. 2 of the drawings, an angle member 45 is attached by fasteners 46 to the outer side of the wooden upright 39 with its flange 47 extending outwardly on the same level as the upper end of the wooden member 39 and a joint cover 48 very much like the joint cover 34 as seen in FIG. 1 of the drawings and heretofore described is then applied for cover the expansion opening 49 between the wooden uprights 38 and 39. A downturned flange 50 on the left longitudinal edge of the joint cover 48 is secured to the wooden upright 38 over the flashing and roofing material by fasteners 51 and the opposite or right side of the joint cover 48 extends outwardly beyond the longitudinal outer edge of the flange 47 of the angle member 45 and has an inturned angular flange 52 like the comparable flange 37 in FIG. 1 of the drawings and heretofore described.

It will thus be seen that expansion or contraction motion of the adjacent roof sections 36 and 37 will result in relative movement of the joint cover 48 and the outturned flange 47 of the angle member 45 thereby providing a freely movable, weather-tight closure between the adjacent roof sections.

Figure 3:
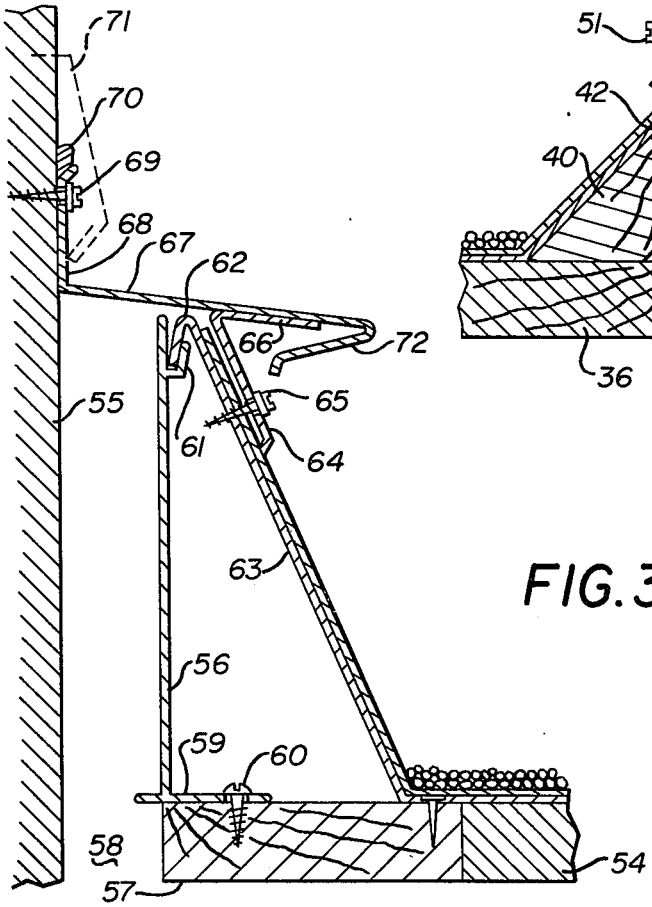
FIG. 3 is a cross sectional elevation of a modification of the roof expansion joint of FIG. 1 altered to form a flashing and expansion joint between the edge of a built up roof and a stationary vertical wall.

A further modification of the roof expansion joint disclosed herein may be seen in FIG. 3 of the drawings wherein the same is adapted to form a flashing between a roof section 54 and a stationary wall 55. The flashing, as seen in FIG. 3 of the drawings, incorporates the expansion properties of the invention. A flanged upright body member 56 is positioned on a longitudinal body member 57 which forms an edge portion of the roof section 54 adjacent an expansion space 58 which separates the roof section 54 from the wall 55. The flanged upright body member 56 has a lower flange 59 attached to the longitudinal body member 57 by fasteners 60 and is provided with an angular flange 61 inwardly of its upper end which receives and holds the downturned longitudinal edge 62 of a sheet metal cant 63, the lower end of which is outturned and secured to the roof section 54. An angle member 64 is attached to the cant 63 by fasteners 65 and its outturned flange 66 is disposed on the same level as the upper end of the upright body member 56 so as to form a sliding support for a cover strip 67. As seen in FIG. 3 of the drawings, the uppermost left end of the cover strip 67 is flanged upwardly as at 68 and secured to the wall 55 by fasteners 69. Caulking 70 may be employed to render the attachment waterproof or alternately a sheet metal flashing 71 as seen in broken lines in FIG. 3, may be installed in a slot in the wall 55 and positioned downwardly over the flange 68 of the cover strip 67.

In this variation of the invention heretofore described, the opposite or right longitudinal edge of the cover strip 67 is flanged inwardly as at 72 and underlies the flange 66 of the angle member 64. The resulting flashing forms a water-tight closure between the wall 55 and the roof section 54 and it provides for the movement of the roof section 54 as by expansion and contraction thereof while maintaining a weather tight seal in the same manner as the comparable parts maintain the seal in the expansion joint structures illustrated in FIGS. 1 and 2 of the drawings and heretofore described.

It will thus be seen that a versatile, lightweight, inexpensive roof expansion joint has been disclosed which may be easily adapted to new and old expansion joint constructions as in FIGS. 1 and 2 of the drawings and to a combination expansion joint and flashing as in FIG. 3 of the drawings and it will occur to those skilled in the art that the constructions are relatively lightweight, easy to handle and install and will perform efficiently for the indicated purpose.

Although but three embodiments of the present invention have been illustrated and described, it will be apparent to those skilled in the art that various changes and modifications may be made therein without departing from the spirit of the invention and having thus described our invention what we claim is:

1. A roof expansion joint structure for bridging and closing an elongated opening in a roof and comprising spaced upright longitudinally extending members defining said opening, longitudinally extending cants attached to said upright members adjacent their upper ends and extending downwardly and outwardly therefrom so as to engage said roof, a longitudinally extending outturned angular flange on the upper end of one of said cants extending opposite said opening, and a longitudinally extending cover strip having a downturned angular flange on one edge and an inturned angularly disposed flange on its other edge extending toward said opening and positioned on and attached to the other one of said cants and slidably engaged on said outturned angular flange, said inturned angularly disposed flange on the cover strip extending inunder said outturned angular flange on the other cant so as to form a movable weather tight seal across said elongated opening in said roof.

2. The roof expansion joint structure set forth in claim 1 and wherein one of said spaced upright members comprises a wall on one side of said elongated opening and the other upright member is positioned on said roof on the other side of said elongated opening.

3. The roof expansion joint structure set forth in claim 1 and wherein said elongated opening in said roof is located between a pair of adjacent flat roof sections and wherein said upright members are positioned on the adjacent edges of said flat roof sections and wherein said cants are positioned on said flat roof sections and extend upwardly toward and are engaged on said upright members.

4. The roof expansion joint structure set forth in claim 3 and wherein said spaced upright members, cants and said cover strip are elongated sections of rigid material.

5. The roof expansion joint structure set forth in claim 3 and wherein said inturned angular flange on said cover strip is positioned relative to said outturned angular flange to limit vertical separation movement of the same and said outturned angular flange on said cant.

6. A roof expansion joint forming a weather tight movable closure between spaced adjacent sections of a flat roof having roofing material thereon and comprising a pair of longitudinally extending upright members positioned on the adjacent edges of said roof sections, oppositely disposed cant members on said roof sections extending upwardly toward and engaged on said upright members, said roofing material extending upwardly on said cant members, an angle member positioned on said upwardly extending roofing material and secured to one of said cant members with one flange thereof extending outwardly therefrom away from said upright members and a generally horizontally disposed longitudinally extending rigid joint cover having a downturned flange on one of its longitudinal edges and a downturned and inturned flange on its other longitudinal edge and positioned over said upright members, said cant members and said roofing material and said outturned flange of said angle member, fasteners securing the downturned flange of the joint cover to one of said cant members so as to engage said roofing material thereon, the downturned and inturned flange of said joint cover being positioned inwardly and inunder said outturned flange of said angle member on the other of said cant members so as to yieldingly limit the vertical movement therebetween, said rigid joint cover and said outturned flange of said angle member arranged for sealing and sliding movement relative to one another.

* * * * *